United States Patent [19]

Craig, III

[11] Patent Number: 4,754,252

[45] Date of Patent: Jun. 28, 1988

[54] THERMOSTATIC SWITCH WITH IMPROVED CAP DISC ASSEMBLY

[75] Inventor: Edmund F. Craig, III, New Bedford, Mass.

[73] Assignee: Elmwood Sensors, Inc., Pawtucket, R.I.

[21] Appl. No.: 57,432

[22] Filed: Jun. 2, 1987

[51] Int. Cl.[4] ..... H01H 37/04; H01H 37/52

[52] U.S. Cl. ..... 337/380; 337/112; 337/372

[58] Field of Search ..... 337/380, 112, 113, 381, 337/372, 365, 348, 354

[56] References Cited

U.S. PATENT DOCUMENTS 2,267,484 12/1941 Houten ..... 337/380

3,720,899 3/1973 Hire ..... 337/348

*Primary Examiner*—H. Broome

*Attorney, Agent, or Firm*—Salter & Michaelson

[57] ABSTRACT

A bimetallic disc-actuated thermostatic switch comprising a switching assembly including a housing containing fixed and movable contacts and a cap and disc assembly on the switching assembly for moving the contacts between engaged and disengaged positions. The cap and disc assembly includes a bimetallic disc, a support disc for supporting the bimetallic disc on the housing, and a retainer cap for retaining the bimetallic disc on the support disc. The cap has at least one air circulation opening therethrough, and the support disc is formed so that air from the exterior of the cap can pass through the air circulation opening and across the underside of the bimetallic disc to provide increased responsiveness to ambient conditions.

9 Claims, 1 Drawing Sheet

THERMOSTATIC SWITCH WITH IMPROVED CAP DISC ASSEMBLY

BACKGROUND AND SUMMARY OF THE INVENTION

The instant invention relates to thermostatic switches, and more particularly to a thermostatic switch which has improved responsiveness to energy transferred via convection.

In certain applications, it can be important for thermostatic switches to be operative with relatively short response times to enable them to rapidly open or close circuits connected thereto in response to temperature changes in their surrounding environments. For example, thermostatic switches which are utilized for protecting various machinery and electronic equipment against over heating must generally be highly responsive to ambient temperature conditions in order to prevent damage to the machinery or equipment with which they are associated. Generally, heretofore, conventional bimetallic disc-actuated thermostatic switches have been utilized for applications of this type; although they have not always been entirely satisfactory for applications which have required extremely high responsiveness to ambient conditions. In this regard, the response times of bimetallic disc-actuated thermostatic switches are generally directly related to the abilities of the bimetallic discs thereof to rapidly absorb energy from their surrounding environments. While in many applications the abilities of the bimetallic discs of thermostatic switches to absorb energy via radiation or conduction are of main importance, in other applications the abilities of the bimetallic discs of switches to absorb energy through convection are of primary importance. However, heretofore, most thermostatic switches have been constructed so that the bimetallic discs thereof are fully enclosed in cap assemblies or housings so that they are not directly exposed to ambient air. Accordingly, the bimetallic discs of most of the heretofore available thermostatic switches have only been indirectly responsive to energy transferred via convection through the caps or housings thereof. Further, while a limited number of bimetallic disc-actuated thermostatic switches have been heretofore available which have included partially exposed bimetallic discs for directly receiving energy via radiation and convection, such switches have only been adapted to enable the bimetallic discs thereof to receive energy through the outwardly facing outer surfaces thereof.

The instant invention provides an effective thermostatic switch which is operative with increased responsiveness to energy transferred via convection. Specifically, the instant invention provides a bimetallic disc-actuated thermostatic switch which, in its preferred form, is constructed so that both the inwardly facing and outwardly facing sides of the bimetallic disc thereof are exposed to the surrounding air for receiving energy via convection. More specifically, the thermostatic switch of the instant invention comprises a basic switching assembly of generally conventional construction and an improved cap and disc assembly on the switching assembly which is adapted to provide increased responsiveness to energy transferred via convection. Still more specifically, the basic switch assembly of the switch of the subject invention comprises a housing, a fixed and movable contacts in the housing, and the cap and disc assembly comprises a bimetallic disc, means supporting the bimetallic disc adjacent one end of the housing, and a retainer cap for retaining the disc on the support means. The switch is further constructed so that the movable contact is movable between engaged and disengaged positions relative to the fixed contact, and the bimetallic disc is of conventional construction and adapted so that it is responsive to a predetermined temperature for movement between actuated and unactuated positions thereof, and the basic switch assembly further comprises means effecting communication between the disc and the movable contact so that the movable contact is moved between the engaged and disengaged positions thereof when the disc is moved between the actuated and unactuated positions thereof. The retainer cap is constructed so that it includes a sidewall portion having an outer end and retainer means on the outer end for retaining the disc on the support means. The retainer cap is further constructed so that it includes at least one air circulation opening in the sidewall portion thereof for effecting communication between the exterior of the retainer cap and the underside of the bimetallic disc, and it is preferably of circular configuration and assembled on the housing so that the bimetallic disc is positioned adjacent the outer end of the sidewall portion of the retainer cap. The retainer cap preferably includes a plurality of air circulation openings therein which are formed as elongated slots extending around at least approximately 80% of the circumference of the cap adjacent the outer end of the sidewall portion. The support means for supporting the bimetallic disc preferably comprises a plurality of spaced support elements which are operative for supporting the disc at a plurality of spaced points adjacent the periphery of the disc so that the underside of the disc communicates with the exterior of the cap through the open areas between the support elements of the support means and through the openings in the sidewall portion of the cap. The retainer means on the retainer cap preferably comprises a substantially circular end wall having an enlarged aperture therein, and it is assembled so that the end wall operates to retain the peripheral portions of the bimetallic disc but so that the central portion of the disc is free to flex and is exposed through the enlarged aperture in the end wall.

It has been found that as a result of the above features, the thermostatic switch of the instant invention is operative with increased responsiveness to ambient conditions by means of energy transferred via convection. Specifically, it has been found that the retainer cap and the support means provide effective direct communication between the ambient air and the inwardly facing underside of the bimetallic disc of the switch in order to increase the amount of heat which is transferred to the disc from the ambient air. The retainer means portion of the cap further increases the responsiveness of the disc to ambient conditions by providing direct communication between the outwardly facing side of the disc and the ambient air.

Accordingly, it is a primary object of the instant invention to provide a thermostatic switch which has improved responsiveness to energy transferred via convection.

Anther object of the instant invention is to provide a bimetallic disc-actuated thermostatic switch wherein direct communication is provided between the underside of the bimetallic disc thereof and the ambient air.

An even further object of the instant invention is to provide a bimetallic disc-actuated thermostatic switch wherein direct communication is provided between both sides of the bimetallic disc thereof and the ambient air.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
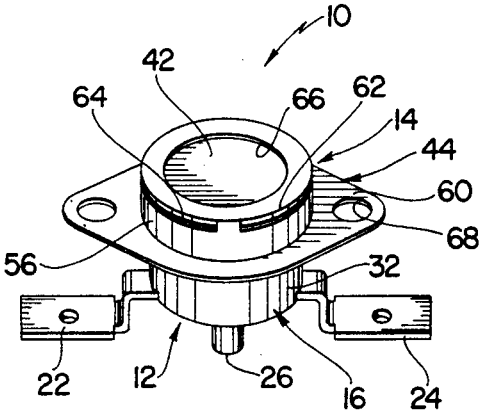
FIG. 1 is a perspective view of the thermostatic switch of the instant invention.
Figure 2:
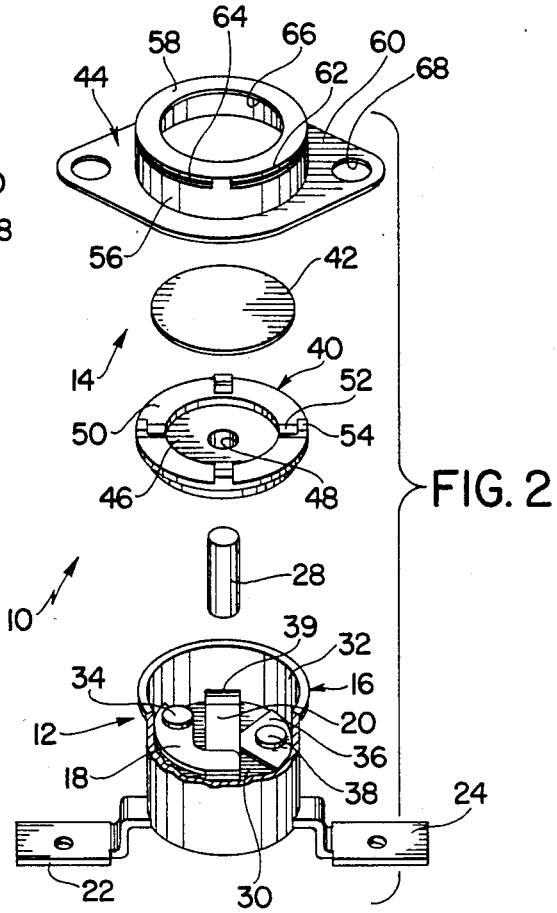
FIG. 2 is an exploded perspective view thereof.
Figure 3:
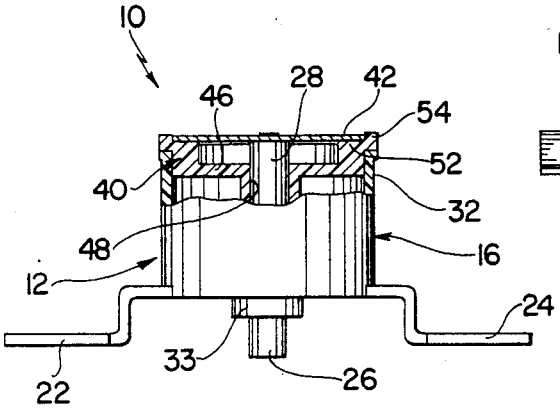
FIG. 3 is a fragmentary side sectional view thereof without the retainer cap.
Figure 4:
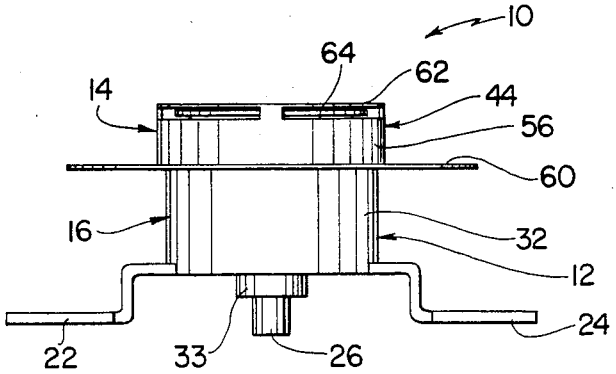
FIG. 4 is a side elevational view of the switch.

Referring now to the drawing, the thermostatic switch of the instant invention is illustrated in FIGS. 1–4 and generally indicated at 10 in FIGS. 1, 2 and 4. The switch 10 comprises a switching assembly generally indicated at 12, and a cap and disc assembly generally indicated at 14 which is operative for actuating the switching assembly 12 in response to a predetermined temperature condition. In this connection, the switching assembly 12 is of generally conventional construction, whereas the cap and disc assembly 14 is adapted to operate with increased responsiveness to ambient conditions for actuating the switching assembly 12, as will hereinafter be more fully set forth. Further, it will be understood that the use of a variety of different switching assemblies in combination with the cap and disc assembly 14 in order to form other embodiments of the switch of the subject invention is contemplated.

The switching assembly 12 comprises a housing 16, fixed and movable contact arms 18 and 20, respectively, first and second external terminals 22 and 24, respectively, a reset pin 26 and a transfer pin 28. The housing 16 is preferably made of a suitable electrical insulating material, such as a phenolic or a ceramic, in a substantially cylindrical configuration, and it has a bottom wall 30 and a sidewall 32 which cooperate to define an inner chamber for the contact arms 18 and 20. An aperture (not shown) extends through the central portion of the bottom wall 30, and an apertured boss 33 is formed on the outer side of the bottom wall 30 so that the aperture (not shown) in the boss 33 extends outwardly from the aperture in the bottom wall 30. The fixed contact arm 18 is made of a suitable metal such as copper or brass, and it has a contact element (not shown) mounted on the underside thereof, and the fixed contact arm 18 is mounted in the housing 16 with a rivet 34. The rivet 34 extends through the bottom wall 30 and through the adjacent portion of the first terminal 22, and hence the rivet 34 operates to both secure the first terminal 22 to the housing and to electrically connect the terminal 22 to the fixed contact arm 18. The movable contact arm 20 is made of a suitable resiliently flexible metal such as copper or brass, and it is integrally formed with a metallic base plate 36. A rivet 38 extends through the base plate 36, the bottom wall 30, and the second terminal 24 so that the rivet 38 operates for securing the base plate 36 and the contact arm 20 in the housing and the second terminal 24 on the underside of the housing 16 and to electrically connect the second terminal 24 to the movable contact arm 20 through the base plate 36. The movable contact arm 20 has a movable contact (not shown) mounted on the upper side thereof, and it includes a connected end 39 which is connected to the base plate 36. The movable contact arm 20 is formed so that the connected end 39 extends upwardly from the base plate 36 and so that the arm 20 then extends to a point adjacent the fixed contact arm 18, and the movable contact on the movable arm 20 is positioned so that it is engageable with the fixed contact on the fixed contact arm 18. The movable contact arm 20 is further constructed so that it is resiliently biased to a position wherein the movable contact thereon (not shown) is in engagement with the fixed contact (not shown) on the fixed arm 18 but so that the movable arm 20 is resiliently separable from the fixed arm 18 to disengage the movable contact from the fixed contact. The reset pin 26 extends through the apertured boss 33 and through the aperture in the bottom wall 30, and it is slidably secured in the housing so that it is engageable with the underside of the movable contact arm 20 to manually move the movable arm 20 against the force of the cap and disc assembly 14 in order to return the movable contact thereon to a position of engagement with the fixed contact on the fixed arm 18 after the fixed and movable contacts have been separated by the cap and disc assembly 14.

The cap and disc assembly 14 comprises a support disc generally indicated at 40, a bimetallic disc 42 and a retainer cap generally indicated at 44. The support disc 40 is preferably made of an electrical insulating material, such as a phenolic, and it comprises a disc-like body portion 46 having a central aperture 48 therethrough, a raised peripheral rim 50 on the upper side of the body portion 46, a plurality of circumferentially spaced upwardly extending support elements 52 on the rim 50, and a plurality of further upwardly extending retainer arms 54 which extend upwardly from the rim 50 adjacent the outer extremities of the support elements 52. The support disc 40 is dimensioned and configurated so that it is receivable on the upper end of the sidewall portion 32 with the body portion 46 received in the sidewall portion 32 and the rim 50 resting on the upper end of the sidewall portion 32. The support elements 52 are constructed and positioned on the upper side of the rim 50 so that they are operative for engaging the peripheral portions of the underside of the disc 42 in order to support the disc 42 in upwardly spaced relation to the rim 50. The retainer arms 54 extend upwardly adjacent the outer extremities of the support elements 52 and they are operative for laterally retaining the disc 42 on the support elements 52 in a position wherein it is in substantially aligned relation with the retainer disc 40. The aperture 48 is dimensioned for slidably receiving the transfer pin 28 therethrough so that the transfer pin 28 is engageable with the bimetallic disc 42 and the movable arm 20 for communicating movement therebetween.

The bimetallic disc 42 is of conventional construction, and it is operative for flexing at a predetermined temperature to move between unactuated and actuated positions thereof. The disc 42 is assembled in the switch 10 so that it is positioned on the support elements 52 in the manner hereinabove set forth whereby it is retained by the retainer arms 54.

The cap 44 is preferably integrally formed from a suitable sheet metal, and it includes a sidewall portion 56, an end wall portion 58, and a flange 60. The sidewall portion 56 is of substantially cylindrical configuration, and it has an outer end 62, and a plurality of elongated circumferentially extending slots or air circulation openings 64 are formed in the sidewall portion 56 adjacent the outer end 62 thereof. In this regard, the air circulation openings 64 are positioned so that when the cap 44 is received over the bimetallic disc 42 with the disc 42 positioned adjacent the end wall 58, the slots 64 provide communication between the exterior of the cap 44 and the underside of the disc 42. The slots 64 are normally formed so that they extend around at least 50% of the circumference of the sidewall portion 56 and preferably so that they extend around at least 80% of the cylindrical sidewall portion 56. The end wall portion 58 extends substantially perpendicularly inwardly from the outer end 62 of the sidewall portion 56, and it has an enlarged central aperture 66 formed therein so that the end wall portion 58 has a substantially ring-like configuration. The flange 60 extends substantially perpendicularly outwardly from the lower end of the sidewall portion 56, and it includes a plurality of mounting holes 68 for mounting the thermostat 10 in a desired location.

When the cap and disc assembly 14 is assembled with the switching assembly 12, the cap 44 is received over the bimetallic disc 42 and the support disc 40 and secured to the housing 16 by suitable means, such as by peening the sidewall portion 56 inwardly. When the cap 44 is assembled with the switching assembly 12 in this manner, the support disc 40 rests on the upper end of the housing 16, and the upper ends of the retainer arms 54 engage the inner side of the end wall portion 58 so that the end wall portion 58 is positioned adjacent the peripheral portion of the bimetallic disc 42. Accordingly, the end wall portion 58 functions to retain the bimetallic disc 42 on the support disc 40, and the aperture 66 enables air to circulate over the upper surface of the bimetallic disc 42, and it provides clearance for the bimetallic disc 42 to flex upwardly. The slots 64 enable air to circulate between the exterior of the cap 44 and the area beneath the disc 42 through the openings which are formed between the support elements 52 on the support disc 40, and the transfer pin 28 extends between the movable contact arm 20 and the bimetallic disc 42 for communicating movement from the bimetallic disc 42 to the movable contact arm 20.

Accordingly, during use and operation of the switch 10, the cap and disc assembly 14 is operative for actuating the switching assembly 12 to effect and interrupt electrical continuity between the terminals 22 and 24 in response to a predetermined temperature condition. Specifically, the disc 42 is movable between an unactuated position wherein the central portion thereof is flexed upwardly and an actuated position wherein the central portion thereof is flexed downwardly, and the bimetallic disc 42 is operative for moving the transfer pin 28 downwardly to thereby move the movable arm 20 downwardly when the disc 42 is in the actuated position thereof. Hence, when the bimetallic disc 42 is moved to the actuated position thereof, it is operative for disengaging the movable contact on the movable contact arm 20 from the fixed contact on the fixed contact arm 18 to interrupt continuity between the first and second terminals 22 and 24, respectively. On the other hand, when the disc 42 is returned to the upwardly flexed unactuated position thereof, the bimetallic disc 42 no longer applies downward pressure to the transfer pin 28 so that the movable arm 20 is resiliently returned to a position wherein the movable contact thereon engages the fixed contact on the fixed arm 18 to again effect electrical continuity between the first and second terminals 22 and 24. The reset pin 26 is operative for manually moving the resilient arm 20 to a position wherein the movable contact thereon is in engagement with the fixed contact on the fixed arm 18, and when the movable arm 20 is manually moved upwardly with the reset pin 26, the transfer pin 28 is also moved upwardly in the switch 18 to manually return the disc 42 to an unactuated position.

During operation of the switch 10, the bimetallic disc 42 is operative with increased responsiveness to ambient temperature conditions as a result of the construction of the cap and disc assembly 14. Specifically, because of the air circulation openings or slots 64 which are formed in the cap 44 and the open areas which are provided between the support elements 52 on the support disc 40, air can circulate freely across the underside of the bimetallic disc 42 to transfer thermal energy between the air and the disc 42. Further, because of the enlarged aperture 66 in the end wall 58, air can also effectively contact the upper side of the disc 42 to further transfer thermal energy between the air and the disc 42. Accordingly, the disc 42 has substantially increased direct communication with the ambient air so that thermal energy can be more effectively transferred thereto via convection; and as a result, the bimetallic disc 42 is operative with substantially increased responsiveness. Consequently, the switch 10 has a high degree of effectiveness and utility for applications wherein the transfer of energy via convection is significant and response times are critical.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. In a thermostatic switch of a type including a housing, fixed and movable contacts in said housing, said movable contact being movable between an engaged position and a disengaged position relative to said fixed contact, a bimetallic disc responsive to a predetermined temperature for movement between actuated and unactuated positions thereof, support means adjacent an end of said housing engaging the peripheral portions of an underside of said bimetallic disc for supporting said bimetallic disc, a substantially circular retainer cap including a sidewall portion having an outer end and retainer means on said outer end for retaining said bimetallic disc on said support means, and means effecting communication between said bimetallic disc and said movable contact so that said movable contact is moved between the engaged and disengaged positions thereof when said bimetallic disc is moved between the acutated and unactuated positions thereof, the improvement comprising a plurality of air-circulation openings in said sidewall portion, said air-circulation openings extending around at least 50% of the circumference of said sidewall portion, said support means supporting said bimetallic disc so that air from the exterior of said retainer cap can pass through said air circulation opening and across the underside of said bimetallic disc.

2. In the thermostatic switch of claim 1, said retainer cap being assembled on said housing so that said bimetalic disc is positioned adjacent the outer end of said retainer cap sidewall portion, said at least one air circulation opening extending through a portion of said sidewall portion which is adjacent the outer end of said sidewall portion.

3. In the thermostatic switch of claim 1, said openings further characterized as elongated circumferentially extending slots and extending around at least 80% of the circumference of said sidewall portion.

4. In the thermostatic switch of claim 1, said retainer means comprising an end wall portion on said sidewall portion outer end.

5. In the thermostatic switch of claim 4, said end wall portion further characterized as having an enlarged central aperture therein, said bimetallic disc being positioned adjacent said end wall portion, the upper side of said disc being exposed through said enlarged aperture.

6. In the thermostatic switch of claim 1, said support means further characterized as supporting said bimetallic disc at a plurality of spaced points adjacent the periphery of said bimetallic disc.

7. In a thermostatic switch of a type including a housing, fixed and movable contacts in said housing, said movable contact being movable between an engaged position and a disengaged position relative to said fixed contact, a bimetallic disc responsive to a predetermined temperature for movement between actuated and unactuated positions thereof, support means adjacent an end of said housing engaging the peripheral portions of an underside of said bimetallic disc for supporting said bimetallic disc, a retainer cap including a sidewall portion having an outer end and retainer means on said outer end for retaining said bimetallic disc on said support means, and means effecting communication between said bimetallic disc and said movable contact so that said movable contact is moved between the engaged and disengaged positions thereof when said bimetallic disc is moved between the actuated and unactuated positions thereof, the improvement comprising at least one air-circulation opening in said sidewall portion, said support means comprising a plurality of spaced support elements for supporting said bimetallic disc at a plurality of spaced points adjacent the periphery of said bimetallic disc, said support means cooperating with said bimetallic disc to from a plurality of open areas between said support elements, the underside of said disc communicating with the exterior of said cap through said open areas between said support element so that air form the exterior of said retainer cap can pass through said air circulation opening and across the underside of said bimetallic disc.

8. In the thermostatic switch of claim 7, said cap and said bimetallic disc being substantially circular, said cap having a plurality of said openings therein, said openings further characterized as elongated circumferentially extending slots and extending around at least 80% of the circumference of said cap.

9. In the thermostatic switch of claim 8, said retainer means comprising an end wall having an enlarged central aperture therein, said bimetallic disc being positioned adjacent said end wall, the upper side of said bimetallic disc being exposed through said enlarged aperture.

* * * * *